US010870063B1

(12) United States Patent
Alexis

(10) Patent No.: US 10,870,063 B1
(45) Date of Patent: Dec. 22, 2020

(54) SPINNING TOY

(71) Applicant: George Alexis, Brooklyn, NY (US)

(72) Inventor: George Alexis, Brooklyn, NY (US)

( * ) Notice: Subject to any disclaimer, the term of this patent is extended or adjusted under 35 U.S.C. 154(b) by 0 days.

(21) Appl. No.: 16/453,105

(22) Filed: Jun. 26, 2019

(51) Int. Cl.

| | |
|---|---|
| ***A63H 1/06*** | (2006.01) |
| ***A63H 1/30*** | (2006.01) |
| *A63H 1/28* | (2006.01) |
| *A63H 1/24* | (2006.01) |

(52) U.S. Cl.
CPC ..... *A63H 1/06* (2013.01); *A63H 1/24* (2013.01); *A63H 1/28* (2013.01)

(58) Field of Classification Search
USPC ..... 446/36–48, 219, 242
See application file for complete search history.

(56) References Cited

U.S. PATENT DOCUMENTS

| | | | | |
|---|---|---|---|---|
| 191,246 | A * | 5/1877 | Mets | |
| 365,201 | A * | 6/1887 | Richard | |
| 1,146,333 | A * | 7/1915 | King | A63H 27/14 446/41 |
| 1,681,524 | A * | 8/1928 | Duchesneau | A63H 27/14 446/42 |
| 2,938,300 | A * | 5/1960 | Newbert | A63H 27/14 446/41 |
| 4,204,359 | A * | 5/1980 | Plo | A63H 27/12 446/41 |
| 5,266,063 | A | 11/1993 | Baumgartnet, Jr. | |
| 5,474,482 | A * | 12/1995 | Davidson | A63H 27/12 446/219 |
| 5,525,086 | A * | 6/1996 | Gentile | A63H 27/10 446/234 |
| 6,083,076 | A | 7/2000 | Saint-Victor | |
| 6,413,144 | B1 | 7/2002 | Williams | |
| 6,589,094 | B2 | 7/2003 | Spencer | |
| 6,802,758 | B2 | 10/2004 | Samers | |
| 7,179,149 | B2 | 2/2007 | Chernick et al. | |
| 7,361,074 | B1 | 4/2008 | Periman et al. | |
| 7,771,247 | B2 | 8/2010 | Kessler | |
| 7,955,157 | B1 | 6/2011 | Hedeen, Jr. | |
| 2002/0098768 | A1 * | 7/2002 | Kuo | A63H 27/12 446/39 |

* cited by examiner

*Primary Examiner* — Nini F Legesse
(74) *Attorney, Agent, or Firm* — Cramer Patent & Design, PLLC; Aaron R. Cramer

(57) ABSTRACT

A spinning toy is housed within a handle-shaped housing and a string actuated internal spinning mechanism. The internal spinning mechanism is secured to a vertical shaft which projects from the top of the housing. Secured to the distal exterior end of the shaft is a propeller comprising a plurality of blades. An exterior end of the string projects through the housing. When the string is pulled it actuates the spinning mechanism which actuates the vertical shaft which in turn rotates the propeller.

14 Claims, 4 Drawing Sheets

SPINNING TOY

RELATED APPLICATIONS

Non-applicable.

FIELD OF THE INVENTION

The presently disclosed subject matter is directed to toys. More particularly, the present invention is directed to hand-held spinning toys.

BACKGROUND OF THE INVENTION

Playing with handheld toys such as tops and gyroscopes, marbles, jacks, bouncing balls, sticks, dexterity skill games and Yo-Yos provides fun entertainment for both children and adults. Passing time, relaxing, and developing hand-eye co-ordination skills are just a few of the reasons that hand-held games remain popular.

One subset of handheld toys is spinning toys such as tops. A major concern with handheld spinning toys is their cost and construction. Modern electronic manufacturing can provide illumination and sound at relative low cost. But to do so electronic manufacturing places a heavy burden on driving operating functions down to a "silicon" layer which can be packaged and installed into or on the toy. However, this mandates the production of a rather high number of the spinning toys to reduce per unit cost as well at the addition of a relatively expensive power source such as a battery. Thus, it is difficult if not impossible to fabricate truly low-cost hand-held spinning toys that incorporate sound and light.

Another problem with handheld spinning toys is how long they last. The need for battery replacement limits the operational life of a handheld spinning toy. In addition, the need for easily damaged switches and internal wiring further reduces the operational life of handheld spinning toys. As such toys are usually subject to rather harsh vibrational operations and user handling the addition of batteries, switches and wiring can reduce operational lifetimes.

In view of the foregoing a handheld spinning toy that does not require electronics or a supporting battery would be beneficial. Preferably to engage a user such a spinning toy would require user actions to create the spinning motion. Ideally a user could cause rotation in either direction Beneficially, to further engage a user such a spinning toy would engage both a user's eye and that user's hands. Such a spinning toy should be suitable for being made available at relatively low cost. Also, beneficially such a spinning toy should be suitable for being implemented in a manner that enables a long service life and in a manner that reduces the risk of harm to the user or those around them.

BRIEF SUMMARY OF THE INVENTION

The principles of the present invention provide for hand-held spinning toys that do not require electronics or a supporting battery. Those hand-held spinning toys engage users by requiring user interactions to create the spinning motion. Such handheld spinning toys are bi-directional and engage both a user's eye and that user's hands. They are suitable for being made available at relatively low cost and for being implemented with long operational lives and in a manner that reduces the risk of harm to the users or to those around them.

A hand-held toy that is in accord with the present invention includes a handle, a rotating element that extends through the handle, at least a first blade and a second blade that extend from the top of the rotating element, and a pull cord that extends from the handle and which is operatively connected to the rotating element so as to cause the first and second blades to rotate. Also included is a finial cap that retains the first blade and the second blade on the rotating element.

The hand-held toy may further include a pull tab on an end of the pull cord. There may be a take-up reel attached to the rotating element such that the take-up reel receives the pull cord. There also may be a spiral spring disposed between the pull cord and the rotating element.

The handle may include a first handle half having fastener apertures and a handle side aperture, a second handle half having fastener receivers, and handle fasteners. The fastener receivers align with the fastener apertures while the handle fasteners pass through the fastener apertures into the fastener receivers to hold the handle together. The pull cord passes through the handle side aperture. The handle halves may form an open top and an open bottom. In that case the handle may further include a handle bottom that fits between the bottom sides of the handle halves and a handle top that fits between the tops sides of the handle halves. The handle bottom may include a vertically extending receiver shaft that receives the bottom of the rotating element. The hand-held toy may further include a finial cap that retains the blades on the rotating member.

A spinning toy that is in accord with the present invention includes a handle having a first handle half with upper fastener apertures as well as a handle side aperture, a second handle half having elongated fastener receivers that are aligned with the upper fastener apertures, and handle fasteners that pass through the upper fastener apertures and into the fastener receivers to hold the handle together. The pull cord passes through the handle side aperture and a rotating element extends through the handle. Also included is a reel that is attached to the rotating element below the fastener receivers. At least a first blade and a second blade extend from the top of the rotating element. A pull cord extends through the handle and is operatively connected to the rotating element to cause the first and second blades to rotate. The vertical movement of the first blade and the second blade are limited by the reel and fastener receivers.

The spinning toy may include a pull cord. There may be a spiral spring within the reel. That spiral spring can transfer force applied to the pull cord to the rotating element. The handle beneficially has an open top, an open bottom, a handle bottom that fits between the bottoms of the handle halves, and a handle top that fits between the tops of the handle halves. The handle bottom includes a vertically extending receiver shaft that receives the bottom of the rotating element while the handle top includes a handle top aperture through which the rotating member passes. The spinning toy can also include a finial cap that retains the blades on the rotating member.

A hand-held spinning toy that is in accord with the present invention includes a handle having a first handle half with upper fastener apertures and a handle side aperture, a second handle half having elongated fastener receivers that are aligned with the upper fastener apertures, and handle fasteners that pass through the upper fastener apertures and into the fastener receivers to hold the handle together. In addition, a pull cord passes through the handle side aperture. There is a rotating element that extends through the handle, a reel that is attached to the rotating element, a spiral spring within the reel such that the spiral spring is attached at its inner end to the rotating element, a first blade and a second blade extend from the top of the rotating element. The pull cord connects within the reel to the spiral spring. Pulling on the pull cord causes the spiral spring to extend, thereby turning the first blade and the second blade in one direction. Releasing the pull cord causes the extend spiral spring to retract, thereby causing the first blade and the second blade to rotate in the opposite direction.

The hand-held spinning toy may further comprise a pull tab on an end of the pull cord. In addition, the handle may have an open top, an open bottom, a handle bottom that fits with the open bottoms and a handle top that fits within the open top. In that case the handle bottom includes a vertically extending receiver shaft that receives the bottom of the rotating element. The handle top includes a handle top aperture through which the rotating member passes. In addition, there may be a finial cap on the rotating member that retains the blades on the rotating member.

BRIEF DESCRIPTION OF THE DRAWINGS

The advantages and features of the present invention will become better understood with reference to the following detailed description and claims when taken in conjunction with the accompanying drawings in which:

DESCRIPTIVE KEY

Figure 1:
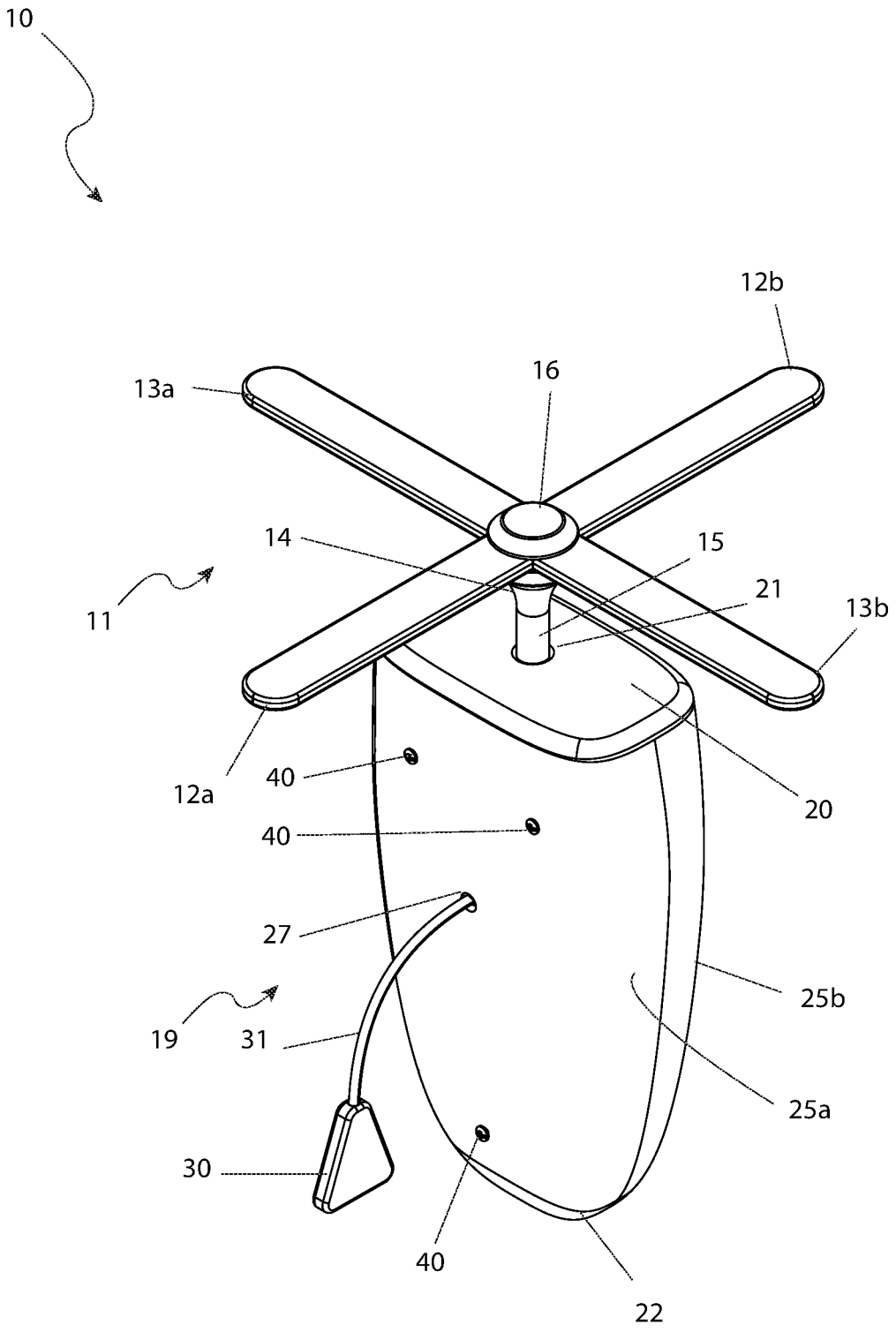
FIG. 1 is a front perspective view of a spinning toy 10 that is in accord with the preferred embodiment of the present invention.

10 spinning toy
11 rotating element
12*a* first blade
12*b* second blade
13*a* third blade
13*b* fourth blade
14 hub
15 shaft
16 finial
18*a* fastener aperture
18*b* fastener receiver
19 handle
20 handle top
21 handle top aperture
22 handle bottom
25*a* first handle half
25*b* second handle half
26 shaft receiver
27 handle side aperture
30 pull tab
31 pull cord
35 reel
36*a* first reel aperture
36*b* second reel aperture
37 spiral spring
40 fastener

DETAILED DESCRIPTION OF THE INVENTION

The preferred embodiment of the present invention is depicted in FIGS. 1 through 5. However, the invention is not limited to the specifically described embodiment. A person skilled in the art will appreciate that many other embodiments of the invention are possible without deviating from the basic concept of the invention. Any such work around will also fall under the scope of this invention.

In the figures like numbers refer to like elements throughout. Additionally, the terms "a" and "an" as used herein do not denote a limitation of quantity, but rather denote the presence of at least one of the referenced items.

Figure 2:
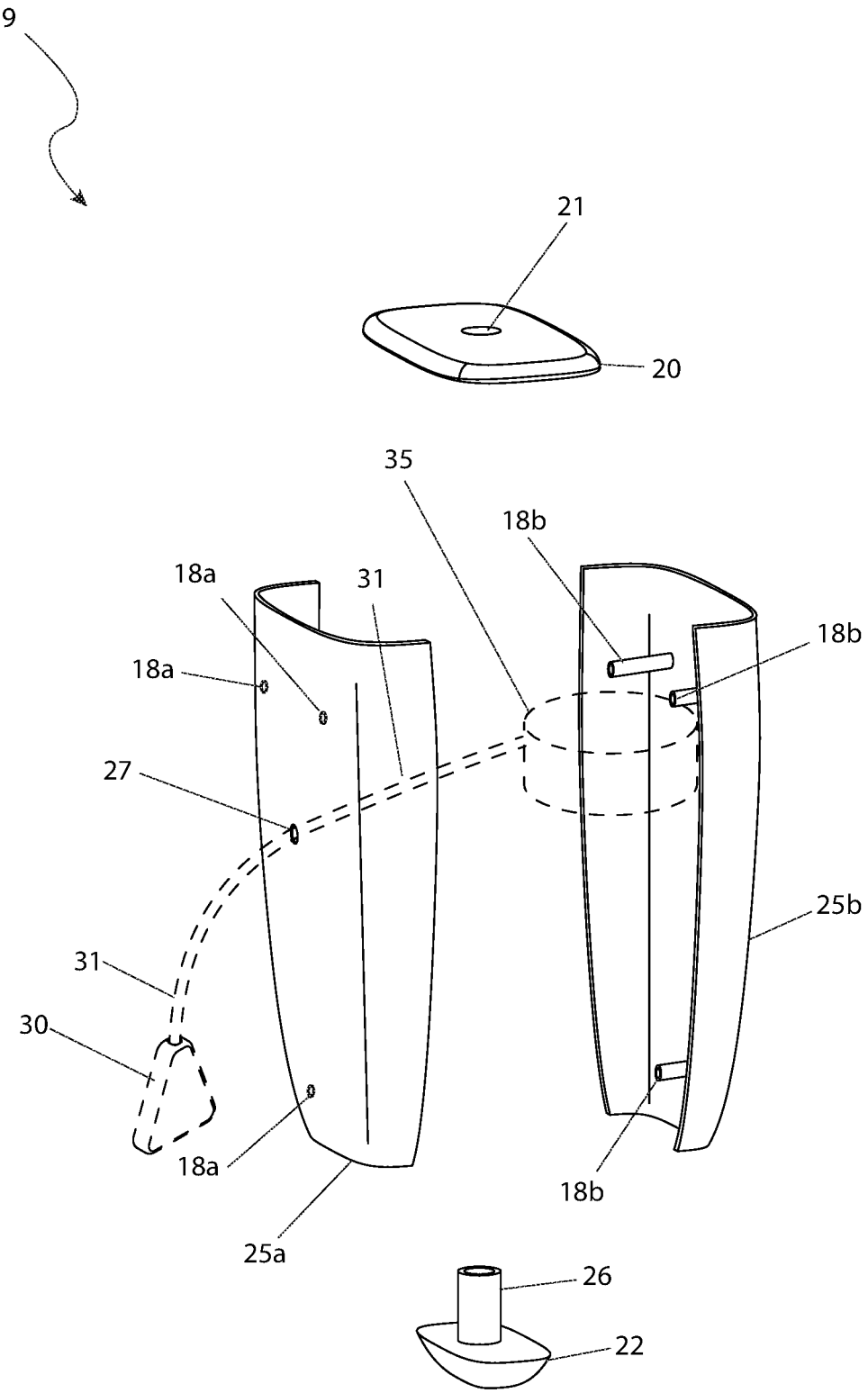
FIG. 2 is an exploded perspective view of a handle 19 that is used in the spinning toy 10 shown in FIG. 1.
Figure 3:
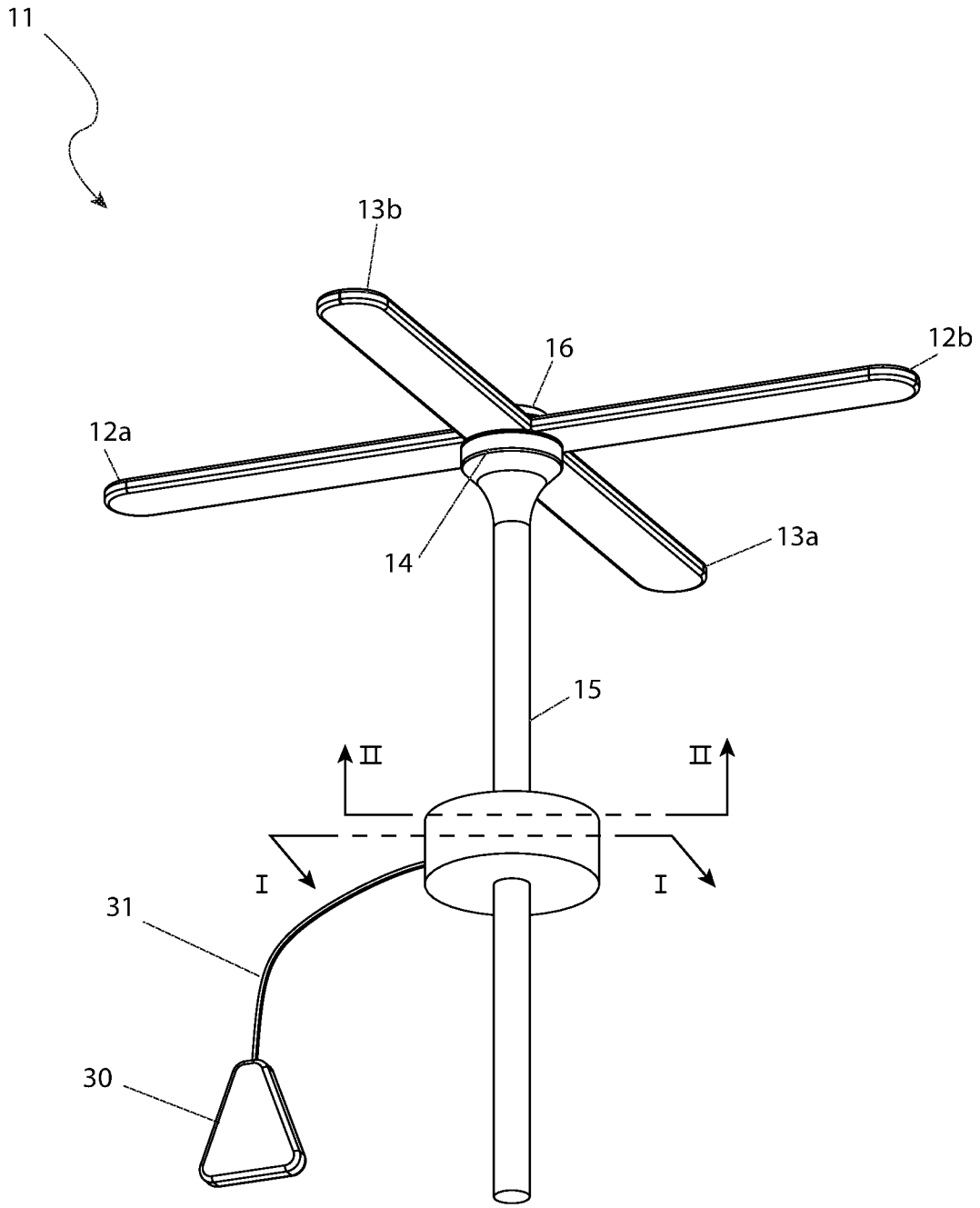
FIG. 3 is a perspective view of a rotating element 11 That is used in the spinning toy 10 shown in FIG. 1.

Refer now to FIG. 1 for a perspective view of a spinning toy 10 that is in accord with the present invention. The spinning toy 10 includes a rotating element 11 that can be manipulated by a user to bidirectionally rotate in an entertaining fashion. Turning now also to FIGS. 2 and 3, the rotating element 11 extends from a handle 19. There are a plurality of blades 12*a*, 12*b*, 13*a*, 13*b* disposed above the handle 19. Extending through a handle side aperture 27 of the handle 19 is a cord 31 with a pull tab 30. That cord 31 passes into the handle 19 and then into a reel 35.

The entire spinning toy 10 is envisioned as being approximately two to three inches (2-3 in.) high, one inch (1 in.) wide, and one-and-one-half inch (1½ in.) thick. It is preferred that the spinning toy 10 is manufactured out of resilient and inert materials, such as plastic, that also are light weight. The handle 19 is beneficially shaped and sized ergonomically to comfortably fit in a hand of a user.

Referring now primarily to FIG. 2 for a view which shows the handle 19 separated into components. The handle 19 includes a first handle half 25*a* that is removably attachable to a second handle half 25*b* using fasteners 40 (reference FIG. 1). The fasteners 40 are beneficially screws. The fasteners 40 pass through fastener apertures 18*a* in the first handle half 25*a* (which also has the handle side aperture 27) and are removably attached to aligned the fastener receivers 18*b* of the second handle half 25*b*.

As shown in FIG. 2 there are two (2) upper pairs and a single lower pair of fastener apertures 18*a* and fastener receivers 18*b*. The two (2) upper pairs of fastener receivers are located such that they restrict the upward vertical movement of the reel 35. Referring now also to FIG. 3, by restricting the upward vertical movement of the reel 35 the upward vertical movement of the rotating element 11 is also restricted.

The first handle half 25*a* and the second handle half 25*b* are essentially mirror image geometrical shapes. Each is comprised of an outer side and an inner side and each is shaped as a gently curvilinear plate. Each plate has rounded opposing longitudinal sides of equal height that curve towards the inner side, a bottom edge, and an upper edge. Each first handle half 25*a*, 25*b* forms an open top side and an open bottom side that cause the cross-section of each first handle half 25*a*, 25*b* to be generally "C"-shaped. The open top is beneficially wider than the open bottom Hence, each first handle half 25*a*, 25*b* tapers in width from the top to the bottom Each first handle half 25*a*, 25*b* is approximately one-eighth of an inch (½ in.) thick.

Still referring to FIG. 2, the handle 19 also includes a handle bottom 22. The handle bottom 22 friction fits within the open bottom The handle bottom 22 has an outer surface that is contoured to friction fit and to form a generally curvilinear bottom of the handle 19. The handle bottom 22 has sides that transition into a generally planar bottom surface.

The handle 19 further includes a handle top 20 that friction fits within the open top. The handle top 20 has an outer surface that is contoured with the outer surfaces of the first handle half 25*a* and second handle half 25*b* to form a generally curvilinear upper end of the handle 19. Centrally located through the handle top 20 is a handle top aperture 21. The handle top aperture 21 enables a shaft 15 of the rotating element 11 (also reference FIGS. 1 and 3) to pass through the handle 19.

Centrally located within the handle bottom 22 is an upwardly vertically extending shaft receiver 26. The shaft receiver 26 receives the bottom end of the shaft 15. The shaft receiver 26 helps maintain the vertical and horizontal stability of the shaft 15 when the rotating element 11 turns. Either or both of the handle top 20 and handle bottom 22 can help facilitate passing the shaft 15 into the shaft receiver 26.

The horizontal and vertical motion restrictions placed on the shaft 15 by the shaft receiver 26, the handle top aperture 21, and the two (2) upper fastener receivers 18*b* retain the rotating element within the handle 19 along the axis between the shaft receiver 26 and the handle top aperture 21 while enabling the rotating element 11 to turn in either direction.

It should be appreciated that the fasteners 40 provide the forces that hold the handle top 20, first handle half 25*a*, second handle half 25*b*, and handle bottom 22 as a unitary structure. The handle 19 is envisioned in at least one (1) embodiment to have an overall appearance of a mango (e.g. *Mangifera indica*) seed.

Referring now to FIG. 3, the rotating element 11 includes the first blade 12*a*, the second blade 12*b*, the third blade 13*a*, and the fourth blade 13*b*, which are all located at the exposed end of the shaft 15. Those blades 12*a*, 12*b*, 13*a*, and 13*b* are coplanarly attached (see below) to a hub 14 which flares outward from the shaft 15. The blades 12*a*-13*b* are beneficially disposed ninety degree (90°) apart about the hub 14.

As best shown in FIG. 1 the blades 12*a*, 12*b*, 13*a*, 13*b* are beneficially held onto the hub 14, and thus onto the shaft 15, by a finial cap 16 that snap fits into the top of the hub 14. In practice the finial cap 16 will be decorative such as by having a spiral or other interesting visual feature then the rotating element 11 rotates. Alternatively, the blades 12*a*, 12*b*, 13*a*, 13*b* can pass into apertures in the hub 14, they can be attached to the outer surface of the hub 14, or they may be integrally formed with the hub 14.

Still referring to FIG. 3, the reel 35 which internally receives the cord 31 can turn about the shaft 15. The reel 35 and its use are described in more detail subsequently with reference to FIGS. 4 and 5. However, it should be understood that the shaft 15 at the other end. Significantly, the first end of the spiral spring 37 is wider than the first reel aperture 36*a*. This prevents the spiral spring 37 from passing through the first reel aperture 36*a*. When the cord 31 this pulled the spiral spring 37 extends and causes the rotating element 11 to rotate in one direction. When the cord 31 is released the spiral spring 37 contracts to its original disposition and rotates the rotating element 11 in the other direction while returning the cord 31 to its original position.

Figure 4:
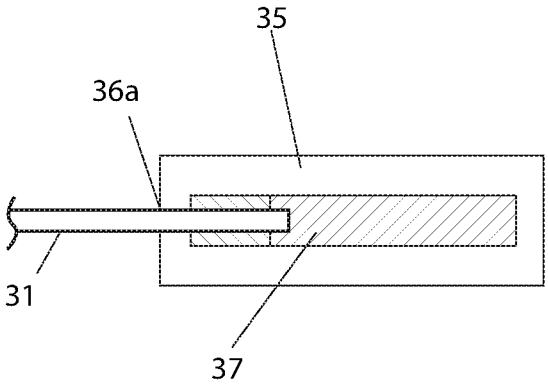
FIG. 4 is a cut-away view taken along line I-I of FIG. 3 and what shows a reel 35; and, FIG. 5 is a cut-away view of the reel 35 along the line II-II of FIG. 3.
Figure 5:
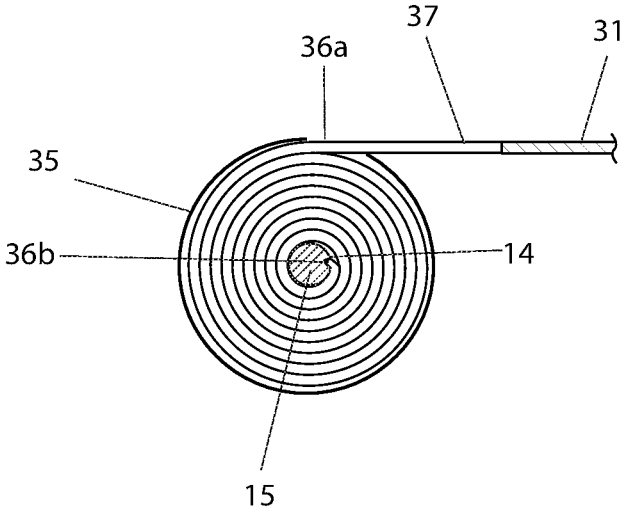

Referring now to FIGS. 4 and 5, the reel 35 also implements a recoil action. The reel 35 is generally toroidal and has an inner diameter that accepts routing the shaft 15 there-through. Importantly, the reel 35 also supports free rotation of the shaft 15 within the interior void of the handle 19.

The cord 31 passes into the reel 35 via a first reel aperture 36*a*. A second reel aperture 36*b* is located inside the reel 35. A coiled spiral spring 37 is located within the reel 35. That spiral spring 37 is attached at one end to the cord 31 and to the shaft 15 at the other end. Significantly, the first end of the spiral spring 37 is wider than the first reel aperture 36*a*. This prevents the spiral spring 37 from passing through the first reel aperture 36*a*. When the cord 31 this pulled the spiral spring 37 extends and causes the rotating element 11 to rotate in one direction. When the cord 31 is released the spiral spring 37 contracts to its original disposition and rotates the rotating element 11 in the other direction while returning the cord 31 to its original position.

The turning of the rotating element 11 causes the finial cap 16 and the blades 12*a*, 12*b*, 13*a*, and 13*b* to turn, thereby creating an interesting visual effect. It should be appreciated that lights and music might be added to the spinning toy 10 by incorporating an embedded microchip and lights and a speaker within or on the handle 19. If so the lights and music can be activated by a switch within the handle 19 or activated by the rotating element 11.

The foregoing descriptions of a specific embodiment of the present invention have been presented for purposes of illustration and description. They are not intended to be exhaustive or to limit the invention to the precise forms disclosed, and obviously many modifications and variations are possible considering the above teaching. The embodiments were chosen and described to best explain the principles of the invention and its practical application and to thereby enable others skilled in the art to best utilize the invention and various embodiments with various modifications as are suited to the use contemplated. The reel 35 is operatively attached to the shaft 15 and to the cord 31 such that a user pulling on the cord 31 (or its pull tab 30) causes and enables the shaft 15 to rotate.

What is claimed:

1. A hand-held toy, comprising:

a handle;

a rotating element having a shaft extending into said handle;

a first blade and a second blade extending from a top of said rotating element;

a pull cord extending from said handle, said pull cord operatively connected to said rotating element to selectively cause said first and second blades to rotate;

a finial cap retaining said first blade and said second blade on said rotating element;

a pull tab on an external end of said pull cord;

a reel within said handle and receiving said pull cord; and a spiral spring disposed between said pull cord and said rotating element.

2. The hand-held toy according to claim 1, wherein said handle comprises a first handle half having fastener apertures and a handle side aperture, a second handle half having fastener receivers, and handle fasteners, wherein said fastener receivers align with said fastener apertures, wherein said handle fasteners pass through said fastener apertures and into said fastener receivers, and wherein said pull cord passes through said handle side aperture.

3. The hand-held toy according to claim 2, wherein said handle further comprises an open top, an open bottom, a handle bottom that fits into said open bottom, and a handle top that fits into said open top, wherein said handle bottom includes a vertically extending receiver shaft that receives the bottom of said shaft.

4. The hand-held toy according to claim 1, wherein said rotating member further includes a hub that mates with said finial cap to retain said blades on said rotating member.

5. A spinning toy, comprising:

a handle having a first handle half with upper fastener apertures and a handle side aperture, a second handle half having elongated fastener receivers aligned with said upper fastener apertures, and handle fasteners that pass through said upper fastener apertures and into said fastener receivers to hold said handle together;

a rotating element having a shaft that extends through said handle;

a reel within said handle and located below said fastener receivers;

a first blade and a second blade extending from the top of said rotating element;

a pull cord extending from said handle through said handle side aperture and operatively connected to said shaft to selectively cause said first and second blades to rotate;

a spiral spring disposed within said reel; and a pull tab on an end of said pull cord;

wherein said pull cord passes into said reel;

wherein a vertical movement of said first blade and said second blade are restricted by said reel and said fastener receivers.

6. The spinning toy according to claim 5, wherein said spiral spring transfers force applied to said pull cord to said rotating element.

7. The spinning toy according to claim 6, wherein said handle further comprises an open top, an open bottom, a handle bottom that fits in said open bottom, and a handle top that fits in said open top, wherein a handle bottom includes a vertically extending receiver shaft that receives the bottom of said rotating element.

8. The spinning toy according to claim 7, wherein said handle top includes a handle top aperture through which said rotating member passes.

9. The spinning toy according to claim 5, further including a finial cap on said rotating member that retains said first and second blades on said rotating member.

10. A hand-held spinning toy, comprising:

a handle having a first handle half with upper fastener apertures and a handle side aperture, a second handle half having elongated fastener receivers aligned with said upper fastener apertures, and handle fasteners that pass through said upper fastener apertures and into said fastener receivers to hold said handle together;

a rotating element having a shaft that extends through said handle;

a reel within said handle;

a spiral spring within said reel, said spiral spring attached at one end to said shaft;

a first blade and a second blade extending from the top of said rotating element; and a pull cord extending through said handle aperture and connected within said reel to said spiral spring, wherein pulling on said pull cord causes said spiral spring to turn said first blade and said second blade in one direction, and wherein releasing said pull cord causes said extend spiral spring to retract, thereby causing said first blade and said second blade to rotate in the opposite direction.

11. The hand-held spinning toy according to claim 10, further comprising a pull tab on an external end of said pull cord.

12. The hand-held spinning toy according to claim 11, wherein said handle further comprises an open top, an open bottom, a handle bottom that fits in said open bottom, and a handle top that fits in said open top, wherein said handle bottom includes a vertically extending receiver shaft that receives a bottom of said shaft.

13. The hand-held spinning toy according to claim 12, wherein said handle top includes a handle top aperture through which said shaft passes.

14. The hand-held spinning toy according to claim 10, further including a finial cap on said rotating member that retains said blades on said rotating member.

* * * * *